United States Patent [19]

Scheffers

[11] Patent Number: 4,522,017

[45] Date of Patent: Jun. 11, 1985

[54] REGISTRATION OF BAGS IN A FILLING MACHINE

[75] Inventor: Richard W. Scheffers, Mount Prospect, Ill.

[73] Assignee: Signode Corporation, Glenview, Ill.

[21] Appl. No.: 429,506

[22] Filed: Sep. 30, 1982

[51] Int. Cl.[3] ..... B65B 43/26

[52] U.S. Cl. ..... 53/570; 53/384; 53/468; 53/568; 141/114; 141/166; 226/143

[58] Field of Search ..... 53/51, 384–386, 53/459, 468, 469, 473, 480, 492, 550, 553, 562, 567, 568, 570; 141/10, 114 X, 165, 166 X, 313, 314, 315, 317, 316; 226/27, 32, 33, 115, 143 X

[56] References Cited

U.S. PATENT DOCUMENTS

| | | | |
|---|---|---|---|
| 3,021,988 | 2/1962 | Focht | 226/143 X |
| 3,198,228 | 8/1965 | Naito | 338/65 |
| 3,291,177 | 12/1966 | Naito | 383/63 |
| 3,338,284 | 8/1967 | Ausnit | 426/654 |
| 3,340,116 | 10/1967 | Naito | 156/92 |
| 3,359,703 | 12/1967 | Quaadgras | 53/567 X |
| 3,477,196 | 11/1969 | Lerner | 242/84.43 |
| 3,597,895 | 8/1971 | Jensen | 292/278 |
| 3,618,286 | 11/1971 | Membrino | 53/459 |
| 3,744,211 | 7/1973 | Titchenal et al. | 53/459 |
| 3,952,480 | 4/1976 | Nordstrom | 53/562 |
| 3,977,586 | 8/1976 | Hertrich | 226/143 X |
| 4,260,116 | 4/1981 | Collin | 242/55 |

*Primary Examiner*—John Sipos
*Assistant Examiner*—Donald R. Studebaker
*Attorney, Agent, or Firm*—Hill, Van Santen, Steadman & Simpson

[57] ABSTRACT

An automated bag filling mechanism particularly adapted to handle reclosable zipper lock-type plastic bags fed into the machine in a bag chain has a bag opening station, a filling station, a bag reclosing station, and a bag separation station, all successively serially arranged in the machine along a transport path in which the bag chain is conducted through the machine. Mechanical means are provided at each station to perform the functions of that station. The mechanical means are sequentially actuated and controlled by the movement of individual cam members keyed for rotation to a continuously driven rotary driveshaft. Means are provided to assure proper alignment or registration of each bag of the chain before the various work stations of the filling mechanism, despite tolerance variations in bag size, slippage in the drive devices, and/or slack development in the chain.

2 Claims, 18 Drawing Figures

VI
29
31
B
N
80
81
78
83
76
66
75
61
65
71
45
21
60
62
100
22
150
151
51
50
59
41
58
56
57
54
55
43
44
52
53
M
34
32
38
37
29
36
35
33
67
69
60
65
71
63
82
64
68
70
77
41
80
81

114
118
116
102
124
117
124
100
103
120
104
128
123
129
125
126
121
122
130
105
41
251
250
252
255
253
254
256
245
231
241

285
302
301
283
290
282
286
280
281
287
293
289
292
291
41
288
284

142
146
145
140
144
147
141
143
159
158
157
166
167
169
170
160
171
168
155
156
154
190
191
192
226
153
X
225
196
195
194
241
242
150
Y
151
164
41
198
165
145
161
163
162
XIII
XIII
140
141
144

FIG. 14
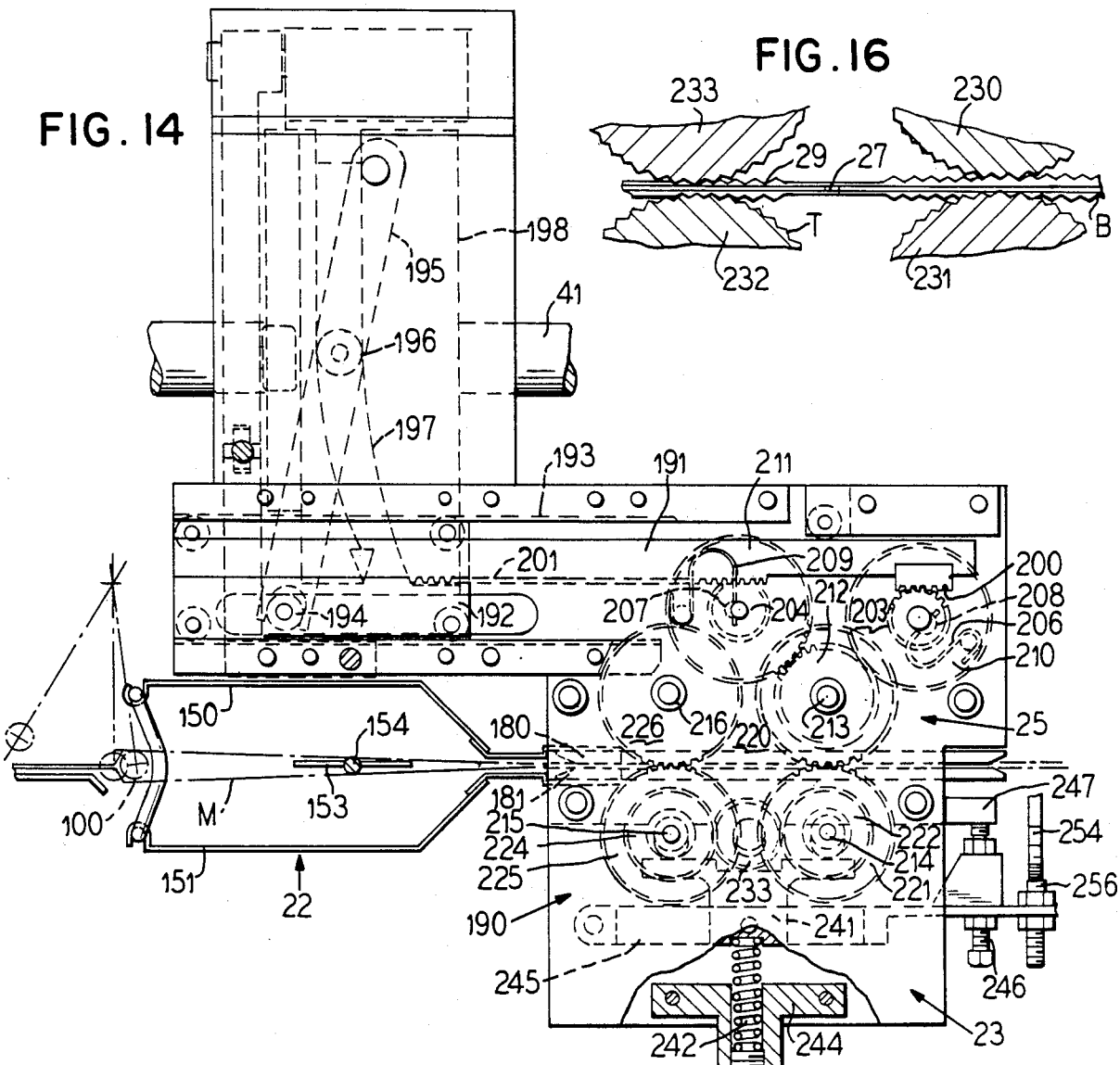
FIG. 16
FIG. 15
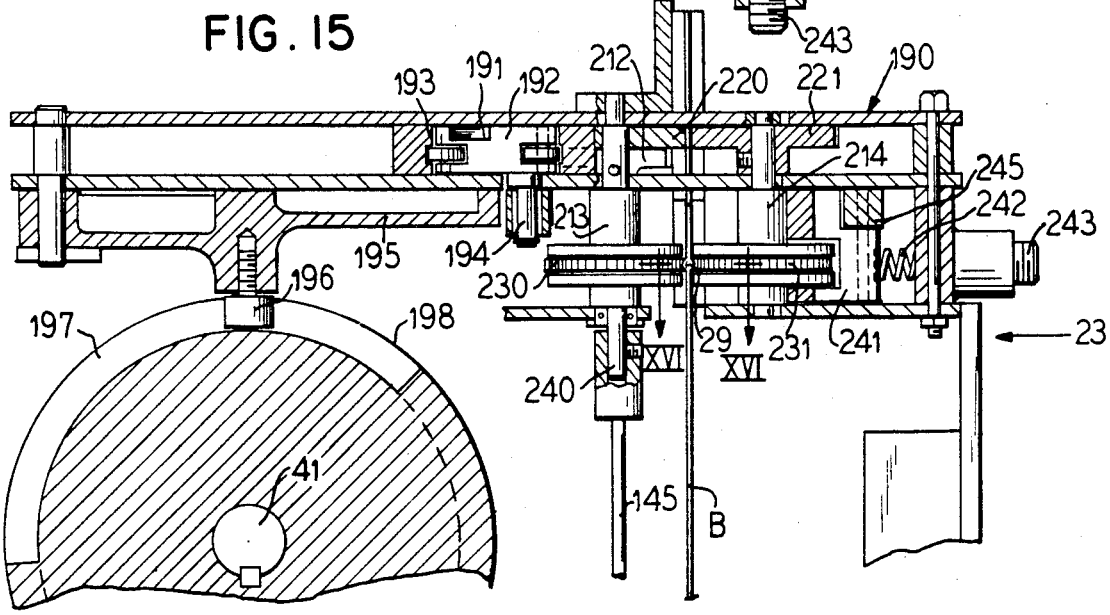

REGISTRATION OF BAGS IN A FILLING MACHINE

CROSS-REFERENCE TO RELATED APPLICATIONS

The instant application relates to subject matter disclosed in the following commonly assigned U.S. patent applications, all filed Sept. 30, 1982, concurrently with this application:

(1) Ser. No. 429,617, entitled "Method And Mechanism For Filling Bags" by Peter Lems, (2) Ser. No. 429,508, entitled "Plastic Bag Chain" by Peter Lems, and (3) Ser. No. 429,507, entitled "Mechanism For Filling Bags Of Different Sizes" by Richard W. Scheffers.

BACKGROUND OF THE INVENTION

The invention relates to an automated bag filling machine for individually opening, filling, closing, and separating zipper-lock, reclosable plastic bags laterally interconnected in a chain and, more particularily, means for assuring proper alignment of each bag before the various work stations of the machine.

Prior to the instant invention, mechanisms for automatically feeding, loading, and sealing plastic bags have been devised. Prior art arrangements of this type are shown, for example, in U.S. Pat. No. 3,477,196 and U.S. Pat. No. 3,952,480. Both of these patents relate to mechanisms for conducting in seriatim a series of plastic bags, originally opened at one mouth end and connected together in a bag chain, to a loading station where the bags are individually loaded with material deposited through their open mouth ends and then to a closing station where the mouth ends of the bags are individually closed by heat sealing means.

No automatic bag loading mechanism has heretofore been devised to handle zipper lock plastic bags of the type disclosed, for example, in U.S. Pat. No. 3,198,228 and presently manufactured by Minigrip, Inc., of Orangeburg, N.Y. This form of bag has closed bottom end and side edges and a reclosable upper end mouth having interlocking fastener strip rib and groove profiles running across inner facing surfaces of the mouth. The nature of manufacture and operation of the reclosable plastic bags present altogether different handling problems than those presented by bags arranged for heat seal closing. For instance, reclosable zipper lock plastic bags are typically closed at their mouth ends during the manufacture process in order to allow proper interfitting of the rib and groove members and exit the manufacturing site in that closed condition. The bag mouths must be opened at a loading site to permit filling and then closed again for packaging. Heretofore known automatic bag loading devices, such as disclosed in U.S. Pat. No. 3,477,196 and U.S. Pat. No. 3,952,480,are not capable of feeding, filling, and sealing reclosable zipper lock plastic bags, since the bag handling mechanisms of these devices are not conducive or adaptable to the unique characteristics of the reclosable bags. Accordingly, it has been necessary to provide manual loading of reclosable lock bags, making such a loading operation very expensive in terms of labor costs and requiring much time since the loader must first manually open the initially closed bag, deposit fill material into the bag, manually interlock the bag mouth fastener strip profiles, and finally transfer the loaded bag to a packaging station.

A mechanism for automatically filling reclosable plastic bags of the zipper-lock type is disclosed herein. The subject invention concerns means by which each bag of a laterally interconnected chain of bags is assured of proper alignment or registration before the various work stations of the filling mechanism, despite tolerance variations in bag size, slippage in drive devices, and/or slack development in the chain.

SUMMARY OF THE INVENTION

An automatic mechanism for transporting, opening, filling, closing, and separately discharging reclosable zipper lock plastic bags sequentially one at a time is arranged to handle the bags in a vertically draped orientation and laterally connected together with one another in a chain. The bags have reclosable upper mouth ends permitting access to the bag interiors formed with lateral interlocking fastener strip profiles. The chain is conducted along a lateral transport path through the mechanism supported by guide track means which receive relatively outwardly protruding surfaces of the fastener profiles.

Initially, the bags enter the mechanism with their mouth ends closed in the fashion they typically leave manufacture and are sequentially passed to a first work station for opening. There, each bag stops while a single gripper conducts one fastener profile further along the transport path relative to the other corresponding opposed profile so as to unlock a portion of the profile strip forming an initial loop opening in the bag mouth at a lead end thereof. A probe member descends into the loop opening and the bag is conducted into a second work station such that the remainder portion of the profiles become separated and the bag mouth is open. At the second work station, the opened bag is indexed backward, while the probe is positioned within a following bag mouth at the first work station, for a slack build-up which transversely separates the opened bag fastener profiles to widen the bag mouth opening for filling. Assist means, such as a rotatable paddle, may also be used to widen the bag mouth opening. After fill material is deposited into the opened bag, the chain is indexed forward, passing the filled bag profiles through a guide which joins the profiles back together in locked engagement. Each filled and closed bag is then passed into a further work station for separation and discharge. A clamp mechanism may be used to hold the bag stationary in the guide track means, while the chain is conducted backwards along the transport path severing the connection between the clamped bag and the next adjacent bag. The separated bag is then dropped from the guide track for discharge from the mechanism.

Forward transport of the chain is regularly interrupted as each bag passes into the next work station to permit an automatic backward indexing of the chain for maintaining consistent proper alignment of the bags with the various work stations. For this step, the probe is connected to a biasing force against which the probe is brought forward by engagement in the trailing end of each bag mouth passing into the second work station and an overtravel by chain transport means. The chain transport means are released via a clutch arrangement, whereupon the biasing force causes the probe to draw the chain backward until reaching a stop for properly registering the bags along the transport path and particularily properly locating the opened bag in the second work station for filling.

Operation of the automated bag filling machine is continuous and fully mechanical, without requiring pressurized shop air.

BRIEF DESCRIPTION OF THE DRAWINGS

FIG. 14 is a fragmentary, cross-sectional plan view of a bag drive means and bag filling and closing stations in the automatic mechanism of FIG. 1.

FIG. 15 is a cross-sectional, side elevational view illustrating the bag drive means.

FIG. 16 is a fragmentary, cross-sectional view taken along the lines XVI—XVI of FIG. 15.

DESCRIPTION OF THE PREFERRED EMBODIMENTS

The present invention is directed to a packaging apparatus and method particularily adapted for automatically loading reclosable zipper lock-type plastic bags. These bags are formed of flexible thin plastic film and have closed bottom and side edges and a reclosable upper end mouth. Running fully across opposed inner facing surfaces of the mouth are a pair of cooperatively interlocking fastener strip profiles formed with respective engageable rib and groove elements. The specific nature of manufacture and handling of reclosable plastic bags is more fully disclosed, for example, in U.S. Pat. Nos. 3,198,228, 3,291,177, 3,338,284 and 3,340,116. During the manufacture of reclosable plastic bags of this type, the releasable interlocking rib and groove elements of the individual bags are brought into relative registration so as to enable their engagement and then the bag sides are cut and heat sealed by a heated blade so as to produce an individual rectangular shaped bag having a releasably closed mouth end. The bag mouth is typically opened by forcibly separating the corresponding opposed fastener strip profiles. A bag mouth is closed by the application of a pressing force which joins together the rib and groove elements. The fastener strips and bags are made of a conventional plastic material such as polyethylene.

Figures 1, 2:
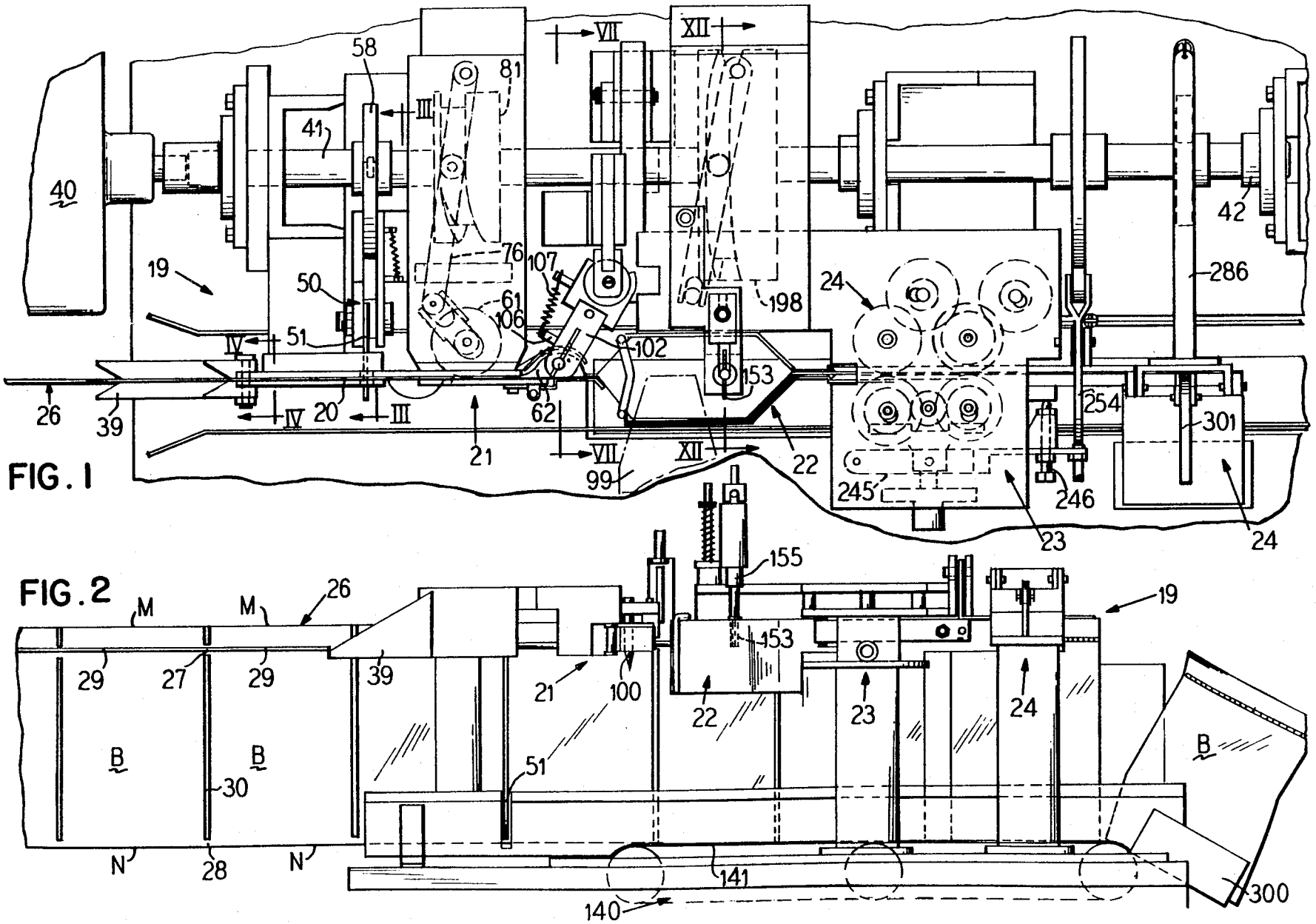
FIG. 1 is a plan elevational view of an automatic mechanism for loading reclosable zipper lock plastic bags constructed in accordance with the present invention.
FIG. 2 is a side elevational view of the automatic mechanism of FIG. 1.

FIGS. 1 and 2 serve to illustrate an overall packaging apparatus 19 for automatically loading reclosable zipper lock plastic bags B one at a time. The apparatus 19 is composed of a series of work stations arranged along a lateral transport path 20 running through the apparatus between a trailing receiving end and a forwardmost discharge end. The apparatus contains, in sequence of operation on each bag, a bag opening station 21, a filling station 22, a drive and closing station 23, and finally a separation or ejection station 24. An intermittent and reversible drive means 25 serves to transport the bags B along the transport path 20 for loading.

In order to permit automatic handling of the reclosable plastic bags, the bags B are serially arranged in a bag chain 26 to be passed in seriatim fashion along the transport path 20. The bags B are vertically draped and interconnected with one another along adjacent side edges by means of relatively thin plastic weld joints 27 and 28 positioned respectively adjacent the upper mouth end M in line with the zipper fastener strip 29 and adjacent the closed bottom end N of each bag. A gap 30 is thus defined between each two corresponding weld joints 27 and 28.

Figures 3, 4, 5, 6:
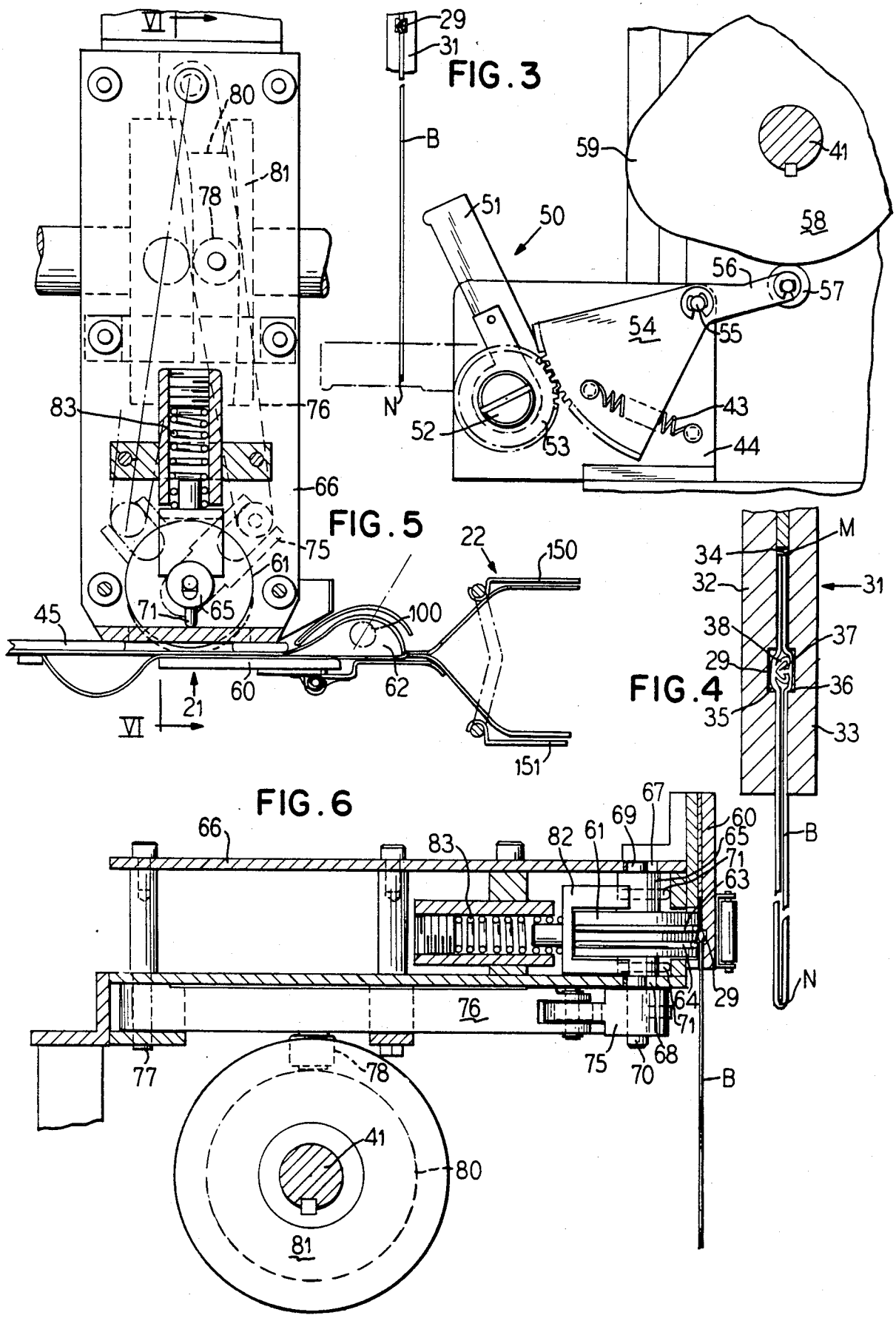
FIG. 3 is a cross-sectional view taken along the lines III—III of FIG. 1.
FIG. 4 is a cross-sectional view taken along the lines IV—IV of FIG. 1.
FIG. 5 is a fragmentary, cross-sectional plan view of a bag opening station in the automatic mechanism of FIG. 1.
FIG. 6 is a cross-sectional view taken along the lines VI—VI of FIG. 5.

The bag chain 26 is conducted through the transport path 20 with the bag mouths M facing vertically upward. The bags in the chain may originally have their mouths M closed with zippers 29 fastened, or interlocked, in the typical production condition after manufacture. The transport path 20 is generally defined by a guide track means 31, as shown in FIG. 4, having opposed facing parallel track surfaces 32 and 33 defining a flow space 34 therebetween. Each of the track surfaces is formed with a recess portion 35 and 36 respectively facing one another for receiving corresponding lateral protruding surfaces, here formed by opposed rib 37 and groove 38 profile elements of each bag's fastener strip 29. In this manner, each bags B of the chain is vertically supported on recess ledge surfaces in the guide track means 41 by passage of the fastener strips 29 therethrough. The guide track 31 has an entry portion 39, shown in FIGS. 1 and 2, at the receiving end of the transport path 20 for initially directing each bag through the apparatus 19.

The packaging mechanism 19 includes a rotary drive motor 40 having a rotary output driveshaft 41 suitably supported at its free end in a bearing housing 42. The driveshaft 41 extends substantially the lateral length of the mechanism and provides a continuous rotary drive source for machine operation. Mechanical movements which take place at each work station operate from suitable drive take-offs from the driveshaft 41, such that the machine work stations operate continuously and simultaneously on the bags of the chain but sequentially on each bag in the chain.

Immediately after entering the transport path 20, each bag B is stopped before a slitter mechanism 50, shown in FIG. 3, and appropriately positioned in a manner discussed below such that the gap 30 between adjacent bag side edges is before a movable knife 51. The knife is mounted for pivotable rotational movement on a pin shaft 52 between an upraised retracted position and an extended lower position, shown in dotted line configuration in FIG. 3, for severing the lower weld joint connection 28 between adjacent bags. The pin shaft 52 has a gear member 53 keyed thereto which engages with a gear toothed bellcrank 54 rotatable about a separate shaft 55. The bellcrank has an inwardly directed arm portion 56 fitted with a cam follower roller 57. The cam follower roller follows the annular surface of a rotary cam 58 keyed to the driveshaft 41. A protruding surface portion 59 on the cam surface causes a brief downward displacement of the cam follower roller 57 which results in the downward cutting stroke of the knife 51. A coil spring 43 connected between the bellcrank 54 and a stationary housing wall 44 serves to bias the roller 57 against the cam surface such that the knife 51 is normally maintained in its retracted upraised position.

During the cutting operation, the forward bag of the two adjacent bags being separated at their lower ends is positioned in the bag opening station 21. Referring now to FIGS. 5 and 6, one fastener strip profile, groove element 38, rests against a guide track surface portion 60 while the corresponding opposed profile, rib element 37, is held before the annular surface of an oscillating drive wheel gripper 61. The drive wheel 61 serves to engage against the facing profile strip portion of the bag to slide that fastener element forwardly relative to the other fastener element, causing the fastener elements to separate and disengage such that an initial loop opening 62, shown in FIG. 5, is formed at a lead end of the bag mouth M.

The drive wheel 61 is formed with annular elastic rings 63 and 64 about the outer circumferential surface thereof for frictionally engaging with the corresponding facing fastener profile of the bag being opened. The drive wheel 61 is fastened for rotation with a vertical shaft member 65. The shaft member 65 is supported in a stationary bracket housing 66 between upper and lower plate portions having transversely elongated openings 67 and 68, respectively, for receiving therein upper and lower reduced end portions 69 and 70, respectively, of the shaft member 65. The shaft member 65 is formed with radially outward protruding cam surfaces 71 which abut against and space the shaft members 65 relative to an outer wall 72 of the support bracket 66 during a predetermined portion of the rotation movement of the shaft member. The lower end portion 70 of the shaft member 65 is relatively elongated for fixed connection with a swivel arm 75 which is pin connected for relative oscillation about one end of a transversely oriented, laterally oscillating lever arm 76. The lever arm 76 is pinned at its opposite end by a pin means 77 fastened on the support bracket 66 and has a vertical guide member 78 positioned intermediately therealong. The vertical guide 78 extends into a cam track groove 80 formed in a rotary cam 81 which is keyed for rotation with the driveshaft 41. The cam track groove 80 extends annularly about the roller 81 defining an angularly profiled circumferential path. Due to the relative position of the guide member 78 in the cam track groove 80, the lever arm 76 is passed laterally back and forth about the pivot axis of the pin means 77.

The shaft member 65 is rotatably received into a U-shaped bearing member 82. A central recess of the U-shaped member serves to accommodate the circumference of the drive wheel 61. The U-shaped member 82 is biased transversely outwardly by a coil spring member 83 which acts against the inward surface of the U-shaped member, such that the shaft member 65 and the drive wheel 61 is under a continuous outward biasing force in the direction of the fastener strip 29 of the bag positioned in the opening station 21.

The loop opening 62 is formed in the following manner. While the bag is being positioned in the opening station 21, the drive wheel 61 is retracted inwardly away from engagement with the corresponding fastener strip in the position shown by the solid line configuration in FIG. 5. At this point, the vertical guide member 78 is oriented in the cam track groove 80 such that the lever arms 76 is in the right hand position shown in FIG. 5 and the upper and lower ends of the drive wheel shaft 65 are pulled back into engagement with the innermost edges of the bracket openings 67 and 68, as shown in FIG. 6, against the bias of the spring 83. When movement of the bag chain 26 has stopped and the bag in the opening station 21 is ready to be opened, the cam 81 will have been rotated such that the guide member 78 is passed laterally from right to left. During this motion of the lever arm 76, the relative movement of the swivel member 75 causes the shaft member 65 to rotate approximately 80° counterclockwise, as shown in FIG. 5. After the initial 30° of shaft member rotation, engagement of the cam surface 71 is released from the support bracket wall 72, such that the shaft 65 is moved under the bias of the spring 83 transversely outwardly whereupon the drive wheel O-rings 63 and 64 engage against the corresponding facing fastener element for the remaining 50° of shaft member rotation, thus producing the loop opening 62. As the cam 81 continues to rotate the relative positioning of the cam groove 80 causes the lever arm 76 to pivot back to its original right-hand position whereupon the cam surface 71 again engages against the bracket wall 72 and retracts the shaft 65 and drive wheel 61.

The loop opening 62 formed in the bag mouth is supported between transversely spaced apart guide bars 90 and 91 as shown in FIG. 5. Initially positioned directly over the loop opening 62 is a vertically reciprocable probe or finger member 100, the operation of which is handled by a mechanical arrangement 101 shown in FIGS. 7–11.

Figure 7:
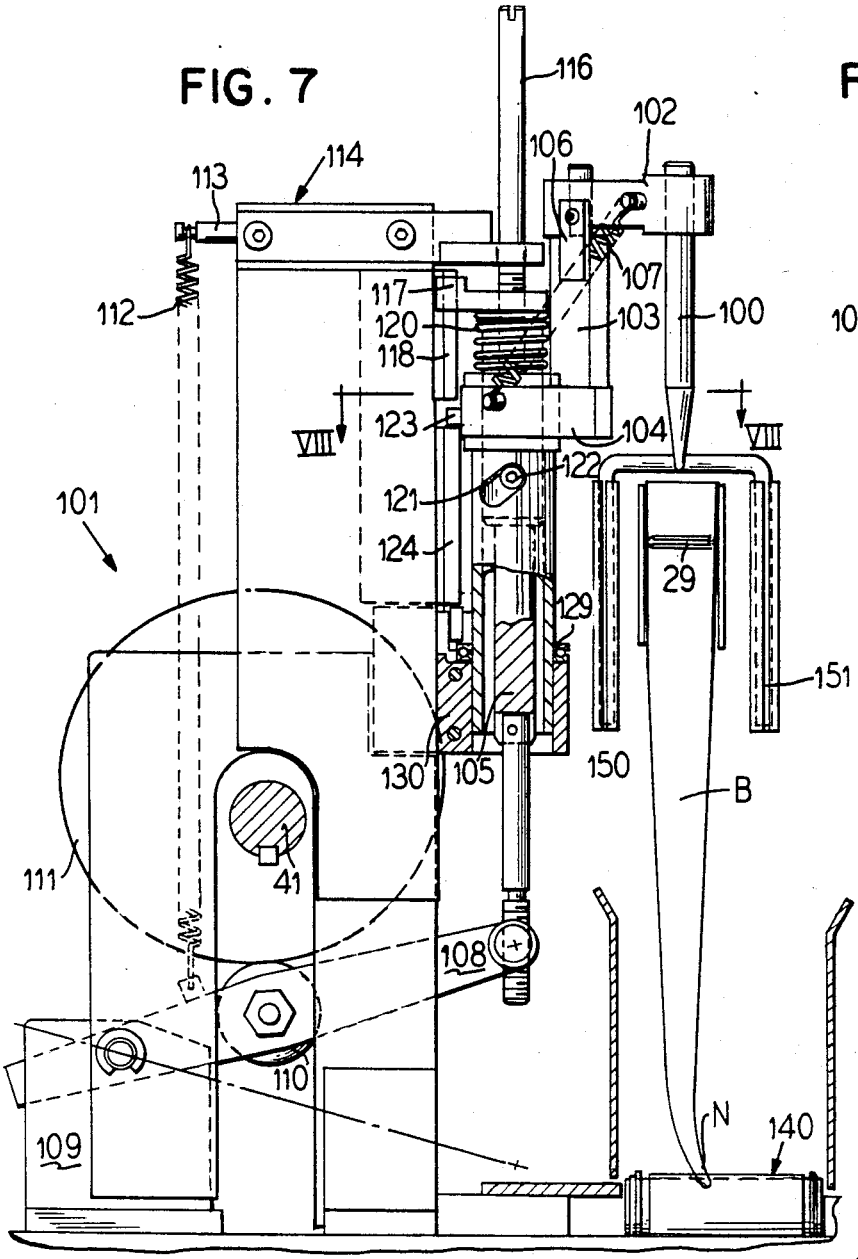
FIG. 7 is a cross-sectional view taken along the lines VII—VII of FIG. 1.
Figure 9:
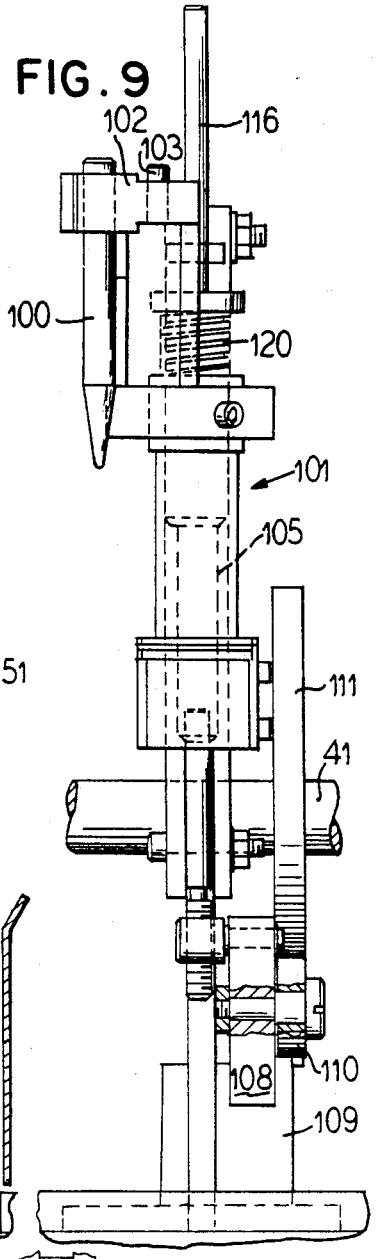
FIG. 9 is a fragmentary, side elevational view of a movable finger mechanism utilized in the automatic mechanism of FIG. 1.

FIGS. 7 and 9 show the initial position of the finger 100 directly over the loop opening 62. The finger is supported at the end of a transversely directed support arm 102 which is pinned for relative lateral rotational movement at the upper end of a vertical bar member 103. The vertical bar 103 is fixedly connected to a base sleeve portion 104 fitted concentrically about a vertically movable shaft 105. Adjacent the upper end of the vertical bar 103 is a stop 106 for backward rotational movement of the support arm and there is a coil spring 107 connected between the support arm 102 and a relatively enlarged upper surface portion of the sleeve 104 for biasing the support arm against the stop 106.

The vertically reciprocable shaft 105 is connected at its lower end with the free end of a lever arm 108. The opposite end of the lever arm 108 is pinned in a stationary housing mounting 109 formed on the mechanism 19. A cam follower roller member 110 is fitted intermediately of the lever arm 108 for riding along the annular control surface of a cam 111 keyed for rotation with the driveshaft 41. A vertically extending coil spring 112 extends between the lever arm 108 and an upper support bar 113 formed on an upstanding housing wall 114 and serves to bias the lever arm roller 110 into engagement with the annular surface of the cam 111 such that the shaft 105 is biased in an upraised direction. The annular surface of the cam 111 serves to raise and lower the lever arm 108 via engagement of the cam follower roller 110 for suitable reciprocation of the shaft 105.

The upper end of the shaft 105 is fitted with a threaded bar portion 116 on which is mounted a transversely extending guide member 117. The guide member 117 is formed with a fork-shaped free end having an opening which engages along a vertically extending protruding guide portion 118 formed on the housing wall 114. In this manner, the guide 117 slides along the protruding wall 118 during vertical reciprocation of the shaft 105 to prevent the shaft 105 from rotating. Between the guide 117 and the upper surface of the sleeve 104, there is provided a coil spring 120 wrapped concentrically about the threaded bar portion 116 of the shaft 105 which serves to bias the sleeve 104 downwardly relative to the shaft 105. The sleeve 104 is provided with a diagonally extending groove opening 121 in which is received an outwardly protruding cam surface 122 formed on the shaft 105. The groove opening 121 permits relative rotation of the sleeve 104 about the shaft 105 in a manner described further below. In the initial position of the finger 100, as shown in FIG. 7, the shaft 105 is fully upraised and the spring 120 biases the sleeve 104 downwardly such that the cam 122 is positioned at the upper end of the groove opening 121. A transversely extending travel pin 123 extends outwardly from the shaft 105 through a suitable opening formed in the sleeve 104 in sliding engagement with a further protruding guide wall portion 124 which extends vertically along the housing wall 114 with freely exposed upper and lower ends.

Figure 10:
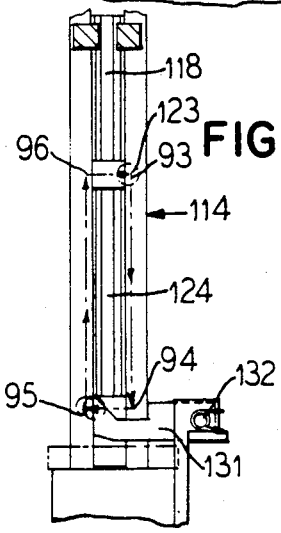
FIG. 10 is a cross-sectional view taken along the lines X—X of FIG. 8.
Figures 11, 17, 18:
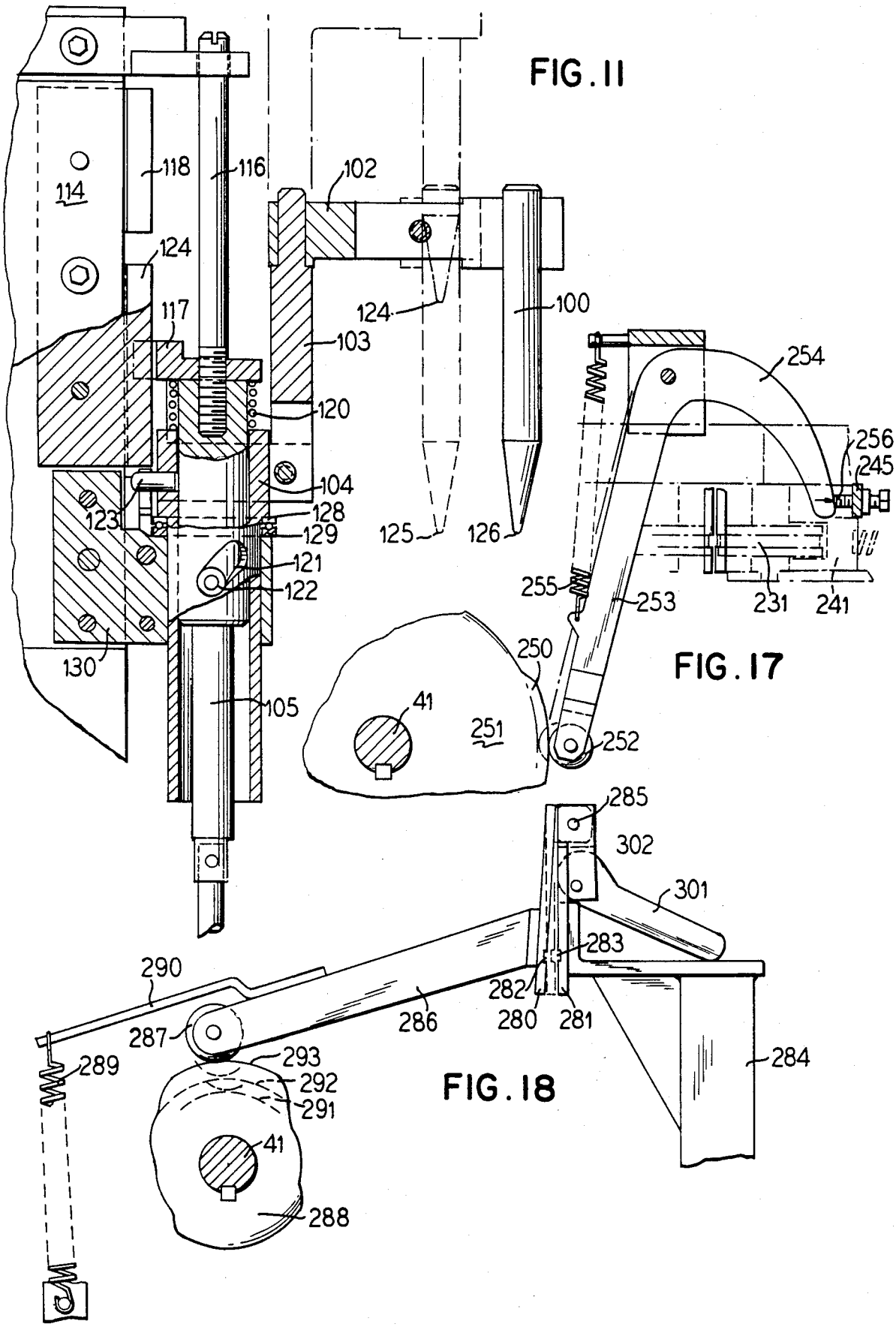
FIG. 11 is a fragmentary, cross-sectional side elevational view of the movable finger mechanism of FIG. 9 illustrating movement thereof.
FIG. 17 is a fragmentary, cross-sectional view of clutch means for briefly releasing bag drive engagement.
FIG. 18 is a fragmentary, cross-sectional front elevational view of a bag separation station for the automatic mechanism of FIG. 1.

Operation of the finger member serves to unfasten the remaining interlocked portions of the fastener strip 29 on the bag trailing the loop opening 62 and also serves to index the bag chain 26 along the transport path 20 against the stop 106 after each bag enters the bag opening station 21 to assure consistent alignment of the bags in their respective work stations and between the slitter knife 51. When the loop opening 62 has been formed in the bag mouth, the finger element 100 descends from an initial upraised position 124, as shown in FIG. 11, downwardly into the loop opening to position 125 by virtue of downward movement of the shaft 105. During this movement, the travel pin 123 slides along the right-hand sidewall surface of the guide surface 124 between positions 93 and 94 as shown in FIG. 10, such that the support arm 102 and finger 100 are oriented relative to the housing wall 114 in the manner indicated by the position 125 showing in FIG. 8. Before the finger element 100 reaches a vertical bottommost position, a lower edge surface 128 of the sleeve 104 is brought to bear against an annular bearing means 129 formed concentrically about the shaft 105 on a housing sleeve portion 130 of the housing wall 114. As the shaft 105 continues to be drawn downward under action of the lever arm 108, the cam pin 122 presses downwardly against the sleeve groove 121, causing the sleeve to rotate counterclockwise, as viewed in FIG. 8, such that the finger 100 draws the lead end of the partially opened bag into the adjacent end of the bag filling station 22, as shown by the finger position 126 shown in FIGS. 8 and 11. During this swivel motion of the sleeve 104, the travel pin passes laterally beneath a lower edge surface of the guide wall 124 in the direction from point 94 to point 95 as shown in FIG. 10. In reaching point 95, the travel pin 123 passes through a one-way latch 131 which is mounted for pivotal movement on the housing surface 114 with one end biased in engagement with the lower edge of the guide wall 124 via a torsion spring 132. As the sleeve 104 is being turned, the support arm 102 for the finger member 100 rotates against the bias of the spring 107 and, the locking of the latch 136 behind the travel pin 123, upon reaching its point 95, prevents the support arm from returning the finger member back out of the filling station. When the finger 100 is inserted in the bag loop opening 62, the gripper wheel 61 is returned to its original position, the finger 100 preventing the return movement of the gripper 61 from re-closing the bag.

With the finger positioned in the bag mouth, the drive means 25 cause the bag chain to be drawn forward along the transport path so as to pull trailing portion of the partially opened bag from the bag opening station 21 into the bag filling station 22. The remaining interlocked elements of the fastener strip profile 29 for the partially opened bag are pulled apart as they pass about opposed sides of the finger member 100. Thus, the bag is drawn into the bag filling station 22 such that the bag mouth M is fully opened.

Figure 8:
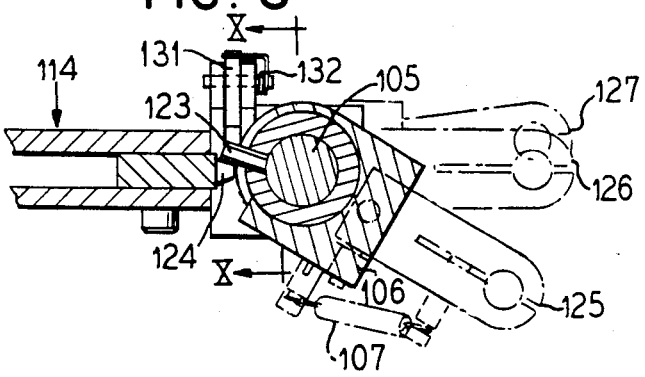
FIG. 8 is a cross-sectional view taken along the lines VIII—VIII of FIG. 7.

With the finger member 100 positioned such that the travel pin 123 is at point 95, the drive means 25 causes a forward overtravel drawing of the bag chain 26, such that the rearward edge of the bag drags the finger member 100 forward against the bias of the spring 107, as indicated by the outermost depicted position 127 of the support arm 102 and finger member in FIG. 8. The overtravel movement of the bag chain 26 serves to compensate for varying bag size within tolerance, possible drive slippage, and/or possible slack in the bag chain which may have developed during its passage through the mechanism 19. As will be described further below, there comes a point when overtravel movement of the bag chain is stopped and the bag chain is released from driving engagement with the drive means 25, so that spring 107 is permitted to draw the finger member 100 backward until the support arm 102 abuts against the stop 106. With this indexing movement, the stop 106 serves as a register point for each bag entering the filling station 22 and for positioning of the bag chain along the transport path since the finger member 100 draws the whole bag chain backward.

After the finger member 100 has been retracted back to the register position at 126 as shown in FIG. 8, continued rotation of the cam 111 causes the lever arm 108 to be raised upward such that the travel pin passes along the left side surface of the guide wall 124, as shown in FIG. 10, from point 95 to point 96 at the upper end of the guide wall. During this upward motion of the shaft 105, the finger member 100 is withdrawn from the rear end of the bag now fully opened and positioned in the filling station 22. When the travel pin 123 reaches point 96, the upper end of the guide wall 124 is exposed such that the biasing force of spring 107 is free to act against the sleeve 104 and the support arm 102. Accordingly, the support arm and sleeve are brought back to their original position as shown in FIGS. 7 and 9, the finger is again at position 124 shown in FIG. 11, and the travel pin is returned to point 93 as shown in FIG. 10 from which the operation of the finger arrangement 101 may again begin.

Figures 12, 13:
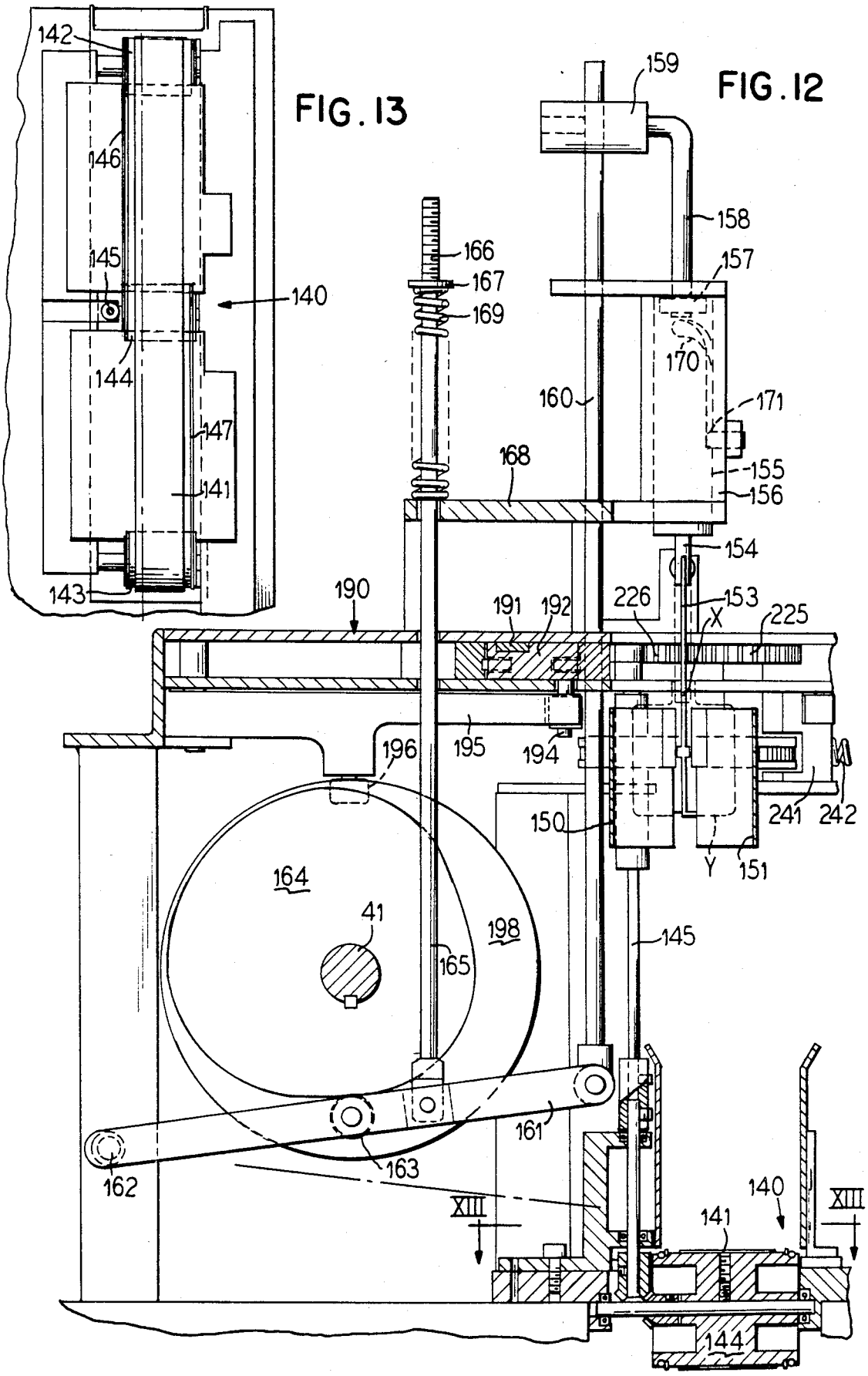
FIG. 12 is a cross-sectional view taken along the lines XII—XII of FIG. 1.
FIG. 13 is a cross-sectional view taken along the lines XIII—XIII of FIG. 12.

Within the filling station 22, the bottom edge N of the bag rests upon the lead end of an optional belt conveyor 140 for supporting the bottom of filled bags. With reference to FIG. 13, the belt conveyor 140 comprises an endless belt 141 trained around opposed end rollers 142 and 143 and about an intermediate roller 144, which is connected for driving rotation simultaneous with the driveshaft 32 through suitable drive transmission means including a vertically extending rotatable shaft 145. The belt conveyor 140 extends from the filling station 22 to the discharge end of the transport path 20. In order to drive the conveyor belt 141, suitable drive loop means 146 and 147 are connected between the driven roller 144 and the end rollers 142 and 143, respectively. The vertical rotary shaft 145 is connected for operation with the drive means 25, such that during snap-back action of the finger member 100 in order to properly register the bag chain in the mechanism 19, the conveyor belt 141 does not move.

With the bag positioned in the filling station 22, the bag mouth M is fully open such that the corresponding opposed fastener strip profiles are separated; however, the mouth opening is substantially only a narrow slit and not presently conducive for loading. With reference to FIGS. 12 and 14, the bag mouth is initially placed in the filling station between two transversely spaced guide bars 150 and 151 in the manner depicted in FIG. 14. Positioned directly vertically over the bag mouth opening, there may be a bag opening assist means, such as a paddle element 153 fixed at the lower end of a vertically reciprocable and rotatable shaft 154. The shaft 154 is connected at its upper end to a cylindrical stub portion 155 containing a fixed cylindrical housing 156. The upper end of the stub 155 is connected by means of a swivel joint member 157 to the lower end of a vertically upstanding bar 158 formed with an attachment means 159 by which the bar 158 is fixedly attached to the upper end of a reciprocable, elongated bar 160. The bar 160 is pin connected at its lower end to the free end of a lever arm 161 which is pivotally pin connected at its other end at a pin mounting 162 formed in a stationary housing surface.

Intermediately of the lever arm 161, there is mounted a cam follower roller 163 which rides along the annular control surface of a rotary cam 164 keyed for rotation with the driveshaft 41. A biasing bar member 165 is attached at its lower end to the lever arm 161 adjacent the cam follower roller 163 and extends upwardly through housing portions of the mechanism 19, terminating with an upstanding threaded free end 166 on which is fitted a threaded plate member 167. A transversely extending stationary housing wall 168 serves to support at one end the lower portion of the sleeve 156 and, at its other end, is formed with a hole through which the biasing bar 165 extends. Between the upper surface of the wall 168 and the plate member 167, there is provided a coiled spring 169 wrapped concentrically about the biasing bar, such that a biasing force is provided which serves to bias the bar 165 and lever arm 161 upwardly so that the cam follower roller engages against the annular surface of the cam 164.

The cam 164 is provided with an eccentric annular surface portion which, when engaging against the cam follower roller 163, causes the lever arm 161 to be directed downwardly against the bias of the spring 169, pulling the shaft 160 and associated bar 158 and cylinder 155 along with it. During this vertical downward movement, the paddle member 153 has its planar surfaces directed laterally longitudinal with the bag chain 26 and passes from an upraised position X as shown in solid line configuration as shown in FIG. 12 toward the interior of the bag mouth M. A vertically extending curved cam groove 170 is formed in the outer surface of the stub 155 for receiving therein a pin member 171 extending inwardly from the cylinder 156. Accordingly, as the paddle 153 descends, it maintains its lateral longitudinal orientation more than halfway through the downward stroke of the bar 160, whereupon the cylinder 155 is turned relative to the support bar 158 such that the pin 171 continues to ride within the cam groove 170. This action causes a 90° turn of the stub 155 on its swivel joint 157, such that the paddle element 153 is likewise turned 90° to be oriented transversely of the bag chain 26 to position Y as shown in dotted line configuration in FIG. 12. The turning of the paddle element causes the corresponding opposed profile element surfaces of the bag mouth to be held apart sufficiently to receive deposit of fill material to be contained in the bags.

However, transverse widening of the bag mouth opening is primarily brought about a positive reverse movement of the chain due to reverse running of the drive means 25. This reverse drive of the chain occurs while the finger 100 is disposed in the loop opening 62 of a subsequent bag, thus holding that bag and the remainder upstream portion of the chain against backward movement. Reverse conduction of the chain develops slack formation in the bag to be filled which manifests itself by transverse separation of the fully opened bag fastener profiles for widening of the mouth opening.

With the bag mouth fully opened, a suitable dispensing mechanism 99 is actuated, either manually or automatically in response to, for example, the end of the reverse drive of the drive means 25, to release a predetermined amount of fill material, such as candy pieces, into the confines of the bag. When filling is completed, the recessed control surface portions of the rotatable cam 164 engage against the cam follower roller 163, enabling the spring 169 to again raise the lever arm 161 upwardly, thus raising the paddle element 153 to its original retracted position X, after the pin 171 riding in the cam groove 170 causes the paddle to turn back through 90°.

With the paddle 153 retracted and the bag filled, the drive means again conduct the bag chain forward along the transport path bringing the filled bag into the closing station 23. As the filled bag is carried forwardly, the bag bottom end N can be supported on the belt conveyor 140, while the upper end of the bag continues to be supported by receipt of the fastener strip profiles of the chain in the transport path track means. Proceeding into the drive and closing station 23, the opposed strip elements of the fastener 29 are squeezed back together into closed or interlocked engagement by guide track means surfaces 180 and 181 constructed in the manner of guide track entry portion 39.

The drive means 25 are contained in the station 23 and operation thereof will now be described with reference to FIGS. 14–16. The bag chain is conducted through a housing block portion 190 in the closing station which extends transversely across the transport path 20. Within the housing block 190, there is provided a laterally directed rack member 191 which is carried by a laterally reciprocable support block 192 positioned in a slide track 193 formed in the housing block 190. The support block 192 is formed with a downwardly extending pin member 194 connected to the free end of a transversely directed lever arm 195. The lever arm 195 is pinned at its other end for lateral pivotal movement relative to the housing block 190 and is formed intermediately with a downwardly extending cam follower pin 196 which rides in a suitably contoured cam slot 197 formed on the annular surface of a rotary cam member 198 keyed to the driveshaft 41. Rotation of the cam 198 causes the lever arm 195 to be pivoted laterally back and forth, with suitable dwell periods, causing corresponding reciprocable movement of the support block 192.

The rack member 191 is formed with first and second sets 200 and 201 of driving teeth, the first set 200 being much shorter than the second. Interposed between the teeth sets is an untoothed gap 202 which serves as a free space. The two teeth sets engage with corresponding respective drive gears 203 and 204. The gears 203 and 204 are mounted on a vertically extending rotatable shaft means in the housing block 190. The upper ends of each of the vertical shafts for the gears 203 and 204 are formed with reduced pin members supported in differently arranged oblong slots 207 and 208, respectively, formed in an upper surface of the housing block 190. The reduced pin portions of the shafts are biased in the slots 206 and 207 by suitable spring clip members 208 and 209, respectively. By virtue of this arrangement, the drive gear 204 is drivingly engaged with the second teeth set portion 201 of the rack member 191 for rotation during forward lateral movement of the rack member; whereas, during this same movement of the rack 191, the vertical shaft for the drive gear 203 slips in the slot 206 such that gear 203 is not drivingly engaged with the first set of teeth 200.

Mounted on each of the vertical shafts for corresponding respective rotation with the drive gears 203 and 204 are gear wheels 210 and 211, respectively. The gear teeth of these gear wheels engage with a further gear wheel member 212 mounted for rotation on a vertical shaft 213 positioned in the housing block substantially outwardly and between the gear wheels 210 and 211. The gear wheel 212 is the first of a gear drive chain for the transmission of simultaneous driving velocity to four vertical rotary shafts 213, 214, 215, and 216, supported in the housing block 190 and positioned on opposed sides of the bag chain flow path through the drive station 24. The bear train comprises the following gears: a larger gear wheel 220 connected for rotation with the shaft 213 for engaging a like-diameter large gear wheel 221 connected to the shaft 214. Beneath the large gear wheel 221 is a reduced diameter gear 222 of the same diameter as gear 212, which engages with an idler gear 223. The idler gear 223 engages with a further gear wheel 224 of a diameter equal to the diameter of the gears 222 and 212 and which is connected for rotation with the shaft 215. Overlying the gear wheel 224 is a large gear wheel 225 of like diameter with gear 221 which drivingly engages with a further like-diameter gear wheel 226 connected for rotation with the shaft 216.

The shafts 213–216 are relatively elongated in the housing block 190 so as to carry respective bag chain drive wheels 230, 231, 232, and 233, arranged in two pairs laterally spaced from one another, as shown in FIGS. 15 and 16.

Each of the bag drive wheels 230–233 are circumferentially formed with jagged teeth T for providing frictional driving engagement against the protruding surfaces, i.e., facing profile elements of the fastener strip 29, of the bag entering the station. The cooperating profile elements are aligned in the guide track means and the pressure engagement of the wheels on either side of the fastener strip further assures that the rib and groove elements are interlocked for reclosing each filled bag. Engagement of the jagged teeth against the fastener strip causes dimpled imprints along the fastener strip surfaces on either side thereof; however, due to the relatively reduced thickness of the upper weld joints 27, the weld joint area may manage to slip between the corresponding wheels without being engaged by the jagged teeth. Accordingly, two sets of drive wheel pairs are provided to assure constant positive driving engagement by the drive means 25 on the bag chain during conduction along the transport path 20. The lower end of shaft 213 is provided with a stub shaft extension 240 which is in drive connection with the rotary shaft 145 for operation of the belt conveyor 140 in conjunction with the bag drive wheels.

The drive wheels 203–233 are simultaneously rotated at identical speeds by virtue of the direct driving engagement of gear teeth in the gear train arrangement. The shafts supporting the outer drive wheels 231 and 232 are pinned at opposed ends in transversely elongated slots formed in upper and lower surfaces of the housing block 190, thus permitting relative transverse movement of these drive wheels toward and away from the bag chain. A holding plate 241 is biased transversely inwardly by a coil spring 242 for engaging against the shafts of the drive wheels 231 and 232, such that the gear train members formed on these shafts have gear teeth in driving engagement with associated gear members of the gear train. The coil spring 242 extends between the holding plate 241 and adjustable stop screw 243 fitted on a fixed support wall surface 244 formed on the housing block 190. The holding plate 241 is pinned to a transversely pivotable arm member 245, which is pinned at one end and provided with an adjustable stop screw member 246 therealong for abutting against a fixed stop wall surface 247 to limit inward movement of the arm member 245.

For forward movement of the bag chain 26 through the bag filling machine 20, the rack member 191 is passed laterally forward such that the teeth length 201 engages against the teeth of the drive wheel 204 in proper driving engagement. Accordingly, rotary movement is transferred between the gear wheel 211 and gear 212 for operation of the gear train members and the bag drive wheels 230–233 rotate serving to draw the bag chain forwardly through the station. During laterally forward movement of the rack member 191, the vertical shaft carrying the drive gear 203 is displaced in the associated oblong slot 206, such that the gear teeth of wheel 203 are not drivingly engaged with the teeth length 200. At the end of the lateral forward movement of the rack member 191, there is a slight dwell period during which the lever arm 195 holds the rack member 191 stationary, allowing time for the bag chain to be indexed backward by virtue of the spring return action associated with the finger member 100.

During this dwell period, a clutch operation occurs which serves to release engagement of the bag chain by the drive means 25 and permit free backward indexing of the chain along the transport path. The clutch occurs in the following manner. A protruding surface 250 formed on a further rotary cam 251 keyed to the driveshaft 41 engages with a cam follower roller 252 connected at one end of a pivot arm 253 shown in FIG. 17. Pivot arm 253 is formed with a curved lead end 254 and pivotally supported along a portion of the pivot arm adjacent the lead end. The pivot arm 253 is biased by a coil spring 255 such that the cam follower roller 252 engages against the annular surface of the cam 251 for controlled actuation of the pivot arm. The free end of the lead portion 254 of the pivot arm abuts against an adjustable screw length 256 which is mounted in the free end of the lever arm 245. With reference to FIGS. 14 and 17, as the cam follower roller 252 rides over the protruding cam surface 250, the lead end portion 254 of the pivot arm 253 is rotated outwardly so as to engage against the screw 256, causing pivotal movement of the lever arm 245 against the bias of the spring 242. By virtue of this movement of the pivot arm 245, driving engagement of the gear members 221 and 225 with the associated gear train members 220 and 226 is broken, since the vertical shafts 214 and 215 are displaced outwardly in the associated oblong slots formed in the housing block. As a result of the outward movement of the vertical shafts 214 and 215, the bag chain is no longer frictionally nipped between the drive wheels 230 and 231 and 233 and 232 and it is at this time that the spring bias of the finger member 100 is free to retract the bag chain 26 along the transport path 20 for registration of the bags.

Substantially simultaneous with the backward indexing of the bag chain in the bag filling machine 20, the rack member 191 is passed in a laterally rearward stroke. As this rearward movement of the rack member 191 begins, the vertical shaft supporting the drive gear 204 is displaced rearwardly in the associated slot means 207, such that the teeth of the drive gear 204 are no longer in driving engagement with the teeth length 201 and the gear member 211 is not in driving engagement with the corresponding gear member 212. There is, furthermore, no driving movement transferred to the drive gear 203 during the initial portion of the rearward stroke of the rack member 191, since the teeth of the drive gear 203 face into the free space portion 202. As the rack member 191 nears the end of its rearward stroke, teeth length 200 drivingly engages with the teeth of the drive gear 203 and driving motion is transferred, since the shaft supporting the drive gear 203 is comfortably positioned at the inward end of the associated oblong slot 206. The rotary motion transferred to drive gear 203 is passed via gear wheel 210 to the gear 212 and thus through the gear train members, causing the bag drive wheels 230–233 to positively rotate in a counterclockwise direction as viewed in FIG. 14. As the rearward stroke of the rack member 191 begins, protruding surface 250 formed on the cam 251 passes beneath the cam follower roller 252 so that the pivot bar 253 is rotated to its initial position out of engagement with the abutment screw 256, whereupon the spring 242 again causes the holding plate 241 to bias the shafts 214 and 215 transversely inward. This movement permits the gear train to again be connected, such that when the teeth length 200 engages against the drive gear 203 and backward drive motion is directed to the bag drive wheels 230–233. This backward drive motion of the bag drive wheels drivingly passes the filled bag backwards into the filling station 21, providing sufficient slack to develop in the narrowly opened bag to cause further transverse widening of the opened bag profiles to expand the bag opening for filling. With the rearward stroke of the rack member 191 completed, there is again a dwell period, during which the rack member is stationary, to permit time for filling of the recently opened bag in the filling station 21. After this dwell period, the rack member 191 begins its forward stroke and the process repeats, causing the filled bag to be conducted completely through the station 23 by virtue of the bag drive wheels 230–233 and support on the belt conveyor 140 into the separation station 24.

From the station 23, the filled bag passes into the separation station 24. With reference to FIGS. 1, 2, and 18, station 24 is formed with guide track wall surfaces 280 and 281 which operate together to form a clamp means. The walls 280 and 281 each contain respective facing recesses 282 and 283 for receiving and supporting the corresponding opposed protruding surfaces of the fastener strip 29 on the filled bag. The guide wall 281 extends in a laterally vertical plane and is fixed to a support wall structure 284 formed on the mechanism 9. The opposed guide wall 280 is pivotally mounted with respect to the fixed guide wall 281 at an upper end hinged connection 285 such that the guide wall 280 may be rotated transversely outward relative to the fixed guide wall. The outer surface of the pivotable guide wall 280 is connected to a pivot arm 286 having a cam follower roller 287 mounted at its free end for riding along the annular control surface of a rotary cam 288 keyed for rotation with the driveshaft 41. The roller 287 is biased toward the surface of the cam 288 by virtue of a coil spring 289 connected to a bracket member 290 attached to the lever arm 286. The cam 288 is formed with three control surface portions 291, 292, and 293, shown in FIG. 18, to produce relative displacement of the cam follower roller 287 and lever arm 286. As the filled bag is passed from the drive station 23 into the station 24, plate 280 adjoins plate 281 such that the receiving recess portions 282 and 283 are substantially contiguous by virtue of the cam follower engaging along the cam surface portion 292 of the cam 288. In this position, the guide wall structures 280 and 281 support the filled bag, such that during the backward indexing of the bag chain, the filled bag is free to be laterally displaced in the station 24. After the bag chain has been registered along the transport path by virtue of the spring action on the finger member 100, the bag drive wheels of the drive means 25 commence rearward driving of the bag chain. At this point, the cam follower roller 287 passes along the control surface portion 291 of the cam 288 causing the pivotable guide plate 280 to clamp the filled bag in the station 25 fixedly against the stationary plate 281, so that driven backward movement of the bag chain causes the filled bag, now properly aligned in the station 24, to be separated from the bag chain by breakage of the remaining upper weld joint 27. The filled bag in the station 25 is now free of the bag chain and the cam follower roller 287 engages along the control surface portion 293 of the cam 288 causing the pivotable plate member 280 to be rotated outwardly and away from the stationary plate 21, as shown in solid line configuration in FIG. 18. This action releases the separated filled bag from the discharge end of the transport path 20 such that the bag drops fully onto the belt conveyor 140. Upon further forward motion of the bag chain, the belt conveyor 140 is once again driven and the separated filled bag is conducted out of the apparatus 19 along a chute 300, as shown in FIG. 2, for deposit into a box for packaging or onto a further conveyor leading to a packaging station.

The separation and discharge station 24 is further provided with a manual control arm 301 which is pin connected to the hinge connection 285 and formed with a cam surface portion 302 abutting against the inward facing back surface of the fixed plate 281 such that upward rotation of the manual arm 301 from its at rest position shown in FIG. 18 causes rotation of the pivotable plate 280 out and away from the fixed plate 281. In this manner, the guide structure in the station 24 may be open to permit threading of the bag chain along the transport path 20 during start-up.

The mechanism described above is uniquely adapted for automatically filling reclosable plastic bags particularly with respect to zipper or fastener strip-type bags. The apparatus of the present invention is adapted to handle bags of substantially uniform size. The structure is uniquely arranged to receive a bag chain consisting of interconnected plastic bags of the type formed with integral interlocking rib and groove zipper profiles in closed condition and open, fill, reclose, and individually separate filled bags from the bag chain for further packaging automatically. The relative settings and spacings for the individual bag handling stations in the inventive automatic machine are dependent upon the particular width of the bags being handled, as well as the particular cam-controlled timings of actions undertaken at the stations along the machine.

Although various minor modifications may be suggested by those versed in the art, it should be understood that I wish to embody within the scope of the patent warranted hereon all such modifications as reasonably and properly come within the scope of my contribution to the art.

I claim as my invention:

1. A device for assuring the proper registration of each bag of a laterally connected bag chain in a filling station of a mechanism for automatically filling bags one at a time conducted laterally therethrough along a transport path, said bags being vertically draped in said chain and each having closed bottom end and side edges and a sealable upper end mouth which is open in said filling station, said apparatus comprising:

drive means for frictionally engaging the bags of said chain and passing said chain in at least a forward direction along said transport path, clutch means for releasing said drive means from frictional engagement with the bags of said chain, A vertically reciprocable probe, a means for extending said probe into the open mouth of each said bag of said chain in said filling station, said probe being mounted for lateral rotation about a vertical axis, a stop for limiting rearward rotation of said probe, and a resilient force means for biasing said probe against said stop, when said clutch means is engaged, the resilient force means acting on said probe for drawing said chain rearward along said transport path to a predetermined registration point set by said stop, whereby said drive means overtravels said chain forwardly along said transport path relative to said filling station and insertion of said probe into said bag mouth enables said drive means to rotate said probe forwardly along with said chain until said clutch means disengages said drive means whereupon said chain is indexed back to said registration point permitting a bag about to be filled to be properly located in said filling station.

2. The apparatus of claim 1, wherein the mouth of each of said bags is formed with reclosably sealable means comprising interlocking fastener strip profiles running laterally across opposed inner facing surfaces of said mouth.

* * * * *